US005385279A

United States Patent [19]

Dawson

[11] Patent Number: 5,385,279

[45] Date of Patent: Jan. 31, 1995

[54] BOOT JACK

[76] Inventor: Tony Dawson, 24 Lansfield Way, Nepean, Ontario K2G 3V8, Canada

[21] Appl. No.: 123,251

[22] Filed: Sep. 20, 1993

[51] Int. Cl.[6] ..... A47G 25/80

[52] U.S. Cl. ..... 223/114; 223/117

[58] Field of Search ..... 223/111, 113, 114, 115, 223/116, 117

[56] References Cited

U.S. PATENT DOCUMENTS

| | | | |
|---|---|---|---|
| 195,712 | 10/1877 | Hull | 223/114 |
| 459,680 | 9/1891 | Donauer | 223/113 |
| 4,262,828 | 4/1981 | Kosakai | 223/115 |
| 5,050,784 | 9/1991 | Turner | 223/114 |
| 5,086,959 | 2/1992 | Jerry et al. | 223/114 |
| 5,121,861 | 6/1992 | Wong | 223/114 |

FOREIGN PATENT DOCUMENTS

| | | | |
|---|---|---|---|
| 32633 | 8/1885 | Germany | 223/114 |
| 83779 | 9/1895 | Germany | 223/114 |

*Primary Examiner*—Clifford D. Crowder
*Assistant Examiner*—Bibhu Mohanty
*Attorney, Agent, or Firm*—Burke-Robertson

[57] ABSTRACT

A boot jack for gripping a boot to assist a user in removal of the user's foot therefrom, of the type comprising a frame and a plate, secured to the frame, having a U-shaped notch for receiving and gripping the boot above the users heel. In this type of boot jack, according to the invention, the plate is supported on a frame in a downwardly inclined orientation towards the notch, when the frame is supported on a horizontal base, the plate being supported at a height above the base to permit the user's toes to press against the base as a fulcrum to facilitate removal of the user's foot from the boot when the boot is gripped in the U-shaped notch. A fulcrum or leverage block may be provided to accomodate variation in size of foot.

12 Claims, 2 Drawing Sheets

BOOT JACK

BACKGROUND OF THE INVENTION

The present invention relates to a boot jack for gripping a boot to assist a user in removal of the user's foot therefrom.

Boot jacks, of the general type having a frame and a plate, secured to the frame, having a U-shaped notch for receiving and gripping a wearer's boot for removal, are well known. In the simplest form, the plate is upwardly and forwardly inclined. The wearer places one foot on the back of the plate and inserts the boot on the other foot in the U-shaped notch. An upward movement of the leg, and a simultaneous downward pivoting of the user's foot about the ankle to align the foot with the leg, enables the foot to be removed from the boot. Such boot jacks may be used for cowboy style boots, but are also useful for other types of boots including overboots worn by persons in wet or snowy conditions, worn directly on the wearer's feet or over shoes on the feet.

Patents of general background interest describing and illustrating boot jacks are U.S. Pat. No. 835,147 of H. Weber issued Nov. 6, 1906; U.S. Pat. No. 624,473 of C. Fredman et al issued May 9, 1899; U.S. Pat. No. 2,876,942 of M. Johnson issued Mar. 10, 1959; U.S. Pat. No. 1,178,109 of J. H. Staubly issued Apr. 4, 1916; Swedish Patent No. 166,129 published Feb. 3, 1959; U.S. Pat. No. 606,947 of H. Strate issued Jul. 5, 1898; U.S. Pat. No. 3,490,661 of K. L. Williams issued Jan. 20, 1970; U.S. Pat. No. 3,526,346 of L. Drouillard et al issued Sep. 1, 1970; U.S. Pat. No. 5,050,784 of Turner issued Sep. 24, 1991; Swiss Patent No. 21010 of Ernest Meyer dated Feb. 14, 1900; German Patent No. 59346 of W. Sonnemann, dated Oct. 14, 1891 and British Patent No. 664,096 of Krohnke published Jan. 2, 1952.

In most of these prior art boot jack and related devices, one leg must be placed behind the other, for removal of a boot, and/or there is an upward motion of the leg, controlled by muscles at the hip and knee joints, as illustrated in FIGS. 1*a, b* and *c*, to permit removal of the boot. In addition, in many previous bootjacks, the surface the foot undergoing boot removal is always flat and horizontal. This restricts the range of plantar flexion to a "tuber angle" of approximately 33°–40°. More particularly, these devices only utilize muscles which act upon the hip and knee joints. While these joints are being flexed, in order to pull the foot vertically upwards, the ankle and metatarsophalangeal joints become passively plantar flexed as they are pushed against the roof of the boot, which is held in a fixed position.

U.S. Pat. No. 5,086,959 of Jerry issued Feb. 11, 1992 describes and illustrates a boot jack of a type having a wire frame defining a V-shaped notch having a downward incline towards the front. Again a user must place one leg behind the other, for holding the jack and a similar upward leg and foot motion, as previously described herein, is required for removal of one's foot.

British Patent No. 1,001,980 of A. E. Clements Limited published Aug. 18, 1965 describes and illustrates a boot jack having upwardly and inwardly oriented converging walls defining a U-shape, for gripping a user's foot, and a platform outwardly extending to the sides and behind these walls. While the user can place one foot beside the other during removal of a boot from one foot, again a similar upward motion of the leg and knee is required in removal of the foot from the boot. A somewhat similar platform construction is taught in Swiss Patent No. 1,220 of Lingner & Kraft dated Jul. 12, 1889. In addition, U.S. Pat. No. 5,086,959, British Patent No. 1,001,980, and Swiss Patent No. 1,220 all do not utilize a leverage mechanism of the foot about the ankle joint.

It is an object of the present invention to provide an alternative construction of boot jack which is simple to construct and yet easy and effective in operation for removal of a users foot from a boot.

SUMMARY OF THE INVENTION

In accordance with the present invention there is provided an improved boot jack of the type for gripping a boot to assist a user in removal of the user's foot therefrom, the jack comprising a frame and a plate, secured to the frame, having a U-shaped notch for receiving and gripping the boot above the user's heel.

In accordance with the invention, the improvement is characterized by the plate being supported on the frame in a downwardly inclined orientation towards the notch, when the frame is supported on a horizontal base. The plate is supported at a height above the base to permit the user's toes and the front of the boot to press against the base to facilitate removal of the user's foot from the boot when the boot is gripped in the U-shaped notch.

In a preferred embodiment of the present invention, the base is a planar platform to which the frame is secured. The platform extends to either side of the frame and plate, to enable the user to place the user's other foot on the platform beside the boot from when the wearer's foot is to be removed, as well as beneath and in front of the frame and plate to support the boot being removed and provide a fulcrum point for the front of that boot during removal.

The boot jack in accordance with the present invention permits the user to be in relatively stable standing position, with one foot beside the other, during removal of the boots, unlike most prior art devices which require one foot to be placed behind the other—a relatively unstable alignment for a person's feet. As well, because of the downward, forward incline of the plate in conjunction with the height at which the plate is supported above the platform, as will be described in more detail hereinafter, a different leg and muscle action, which for some people may significantly facilitate removal of one's foot from a boot, is accomplished.

BRIEF DESCRIPTION OF THE DRAWINGS

These and other objects and advantages of the invention will become apparent upon reading the following detailed description and upon referring to the drawings in which.

Figure 1A:
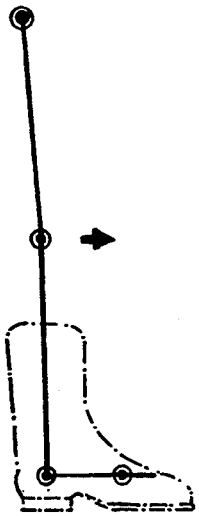
FIGS. 1*a, b* and *c* are schematic views of leg actions for removal of one's foot from a boot using prior art boot jacks of the type described.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 2:
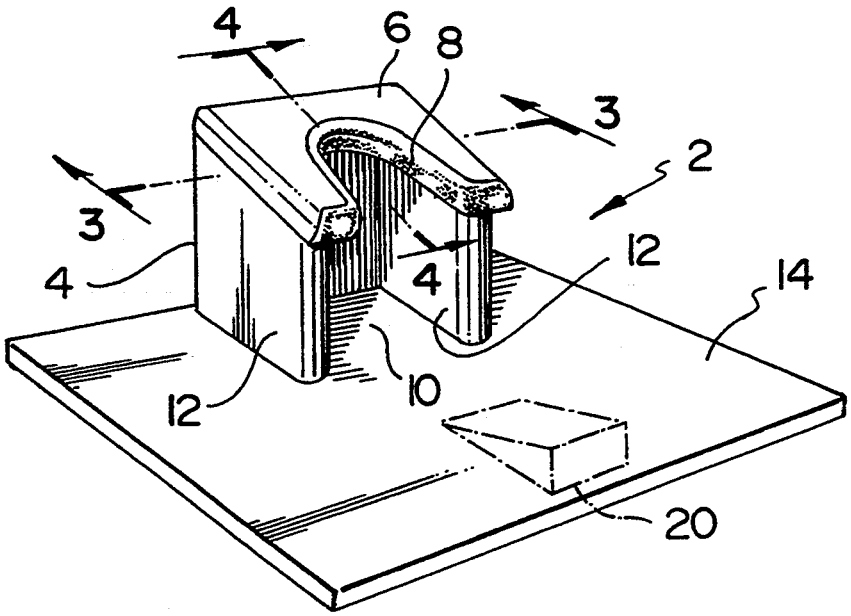
FIG. 2 is a perspective view of a boot jack, mounted on a platform, in accordance with the present invention.

Turning to the drawings, and in particular FIG. 2, there is illustrated a boot jack 2 for gripping a boot to assist a user for removal of the user's foot therefrom. The jack 2 is of the type comprising a frame 4, supporting a plate 6 having a U-shaped notch 8 for receiving and gripping the back of a boot to be removed, above the wearer's heel. In accordance with the present invention, plate 6 is supported on the frame in a downwardly and forwardly inclined orientation, as illustrated. This angle with respect to the horizontal base is preferably in the range of 33° to 40°. Frame 4, comprising back wall 10 and side walls 12, are secured to a rectangular platform 14 to provide a rigid support for plate 6. Walls 10 and 12 are of a height so that plate 6 is supported above the platform at a height to permit the user's toes and the front part of the boot, to press against the platform as a fulcrum to facilitate the removal procedure when the boot to be removed is gripped in the U-shaped notch. This height of course may be predetermined, or adjustable, to provide a proper location of plate 6 for a particular user having a particular leg and foot size.

Figure 1B:
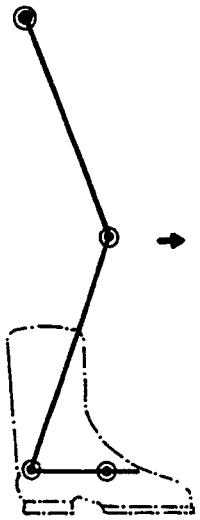
Figure 1C:
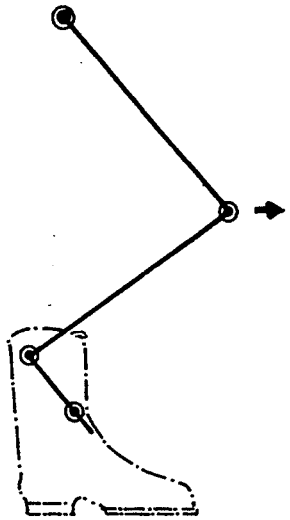
Figure 4:
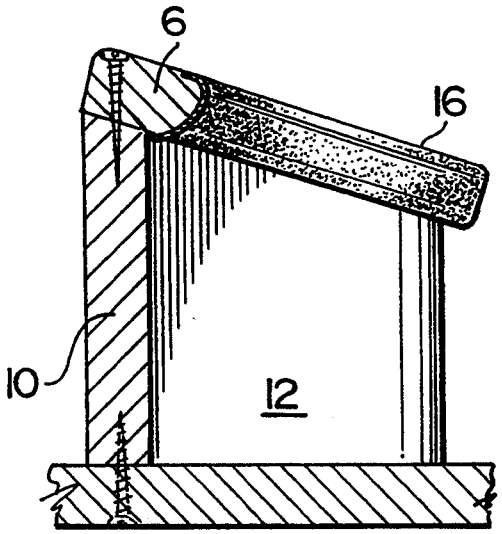
FIG. 4 is a section view of the plate and portion of the base along line 4—4 of FIG. 2.
Figure 3:
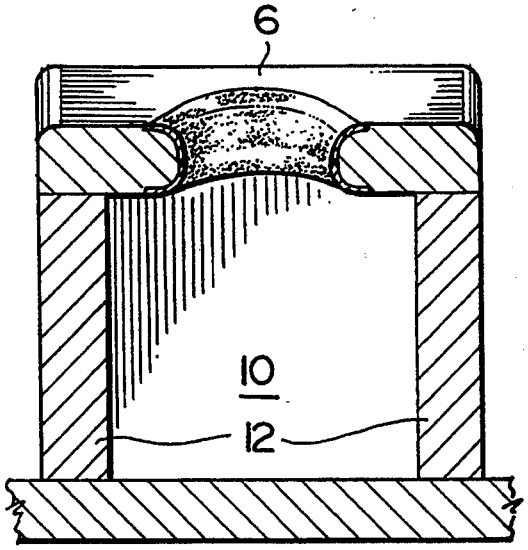
FIG. 3 is a section view of the plate and portion of the base along line 3—3 of FIG. 2.
Figure 5A:
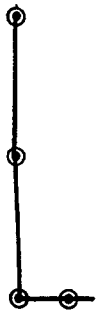
FIGS. 5*a, b, c* and *d* are schematic views of leg actions for removal of one's foot from a boot using the boot jack of FIG. 2.
Figure 5B:
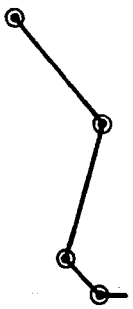
Figure 5C:
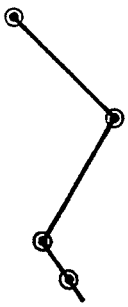
Figure 5D:
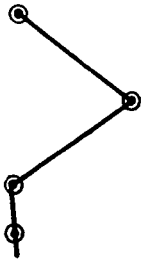

As can be seen in FIG. 3, it is preferred that plate 6 be slightly tapered from back to front. As can be seen in the section views of plate 6 illustrated in FIGS. 3 and 4, it is also preferred that the edges 16 of U-shaped notch 8 be rounded slightly downwardly and outwardly bevelled, particularly near the back of notch 8, to conform to the corresponding portions of the boot to be removed, and thereby wedge the boot more securely in notch 8 during the removal process. It is further preferred that edge 16 be made of a boot protecting, friction enhancing material such as for example suede. As can be seen when comparing the schematic views of FIGS. 1*a*, 1*b* and 1*c* with those FIGS. 5*a*, 5*b*, 5*c* and 5*d*, the leg and foot actions of a person whose foot is being removed from a boot using the boot jack 2 in accordance with the present invention (FIGS. 5*a*, 5*b*, 5*c* and 5*d*) differs significantly from those required using previously known boot jacks (FIGS. 1*a*, 1*b* and 1*c*). In particular, the toes and the front of one's foot become significant in providing upward force to the joint and leg, when moving then into aligned position for removal of the boot. The critical difference lies in, the increased range of plantar flexion, the types of muscles which are used and their order of recruitment. More particularly, using the boot jack 2 in accordance with the present invention to remove a foot from a boot, instead of being a passive process as in previous boot jacks, the process of removing one's foot from a boot using the boot jack of the present application is a very active one. Active recruitment of a number of muscles surrounding the ankle joint is involved: e.g. peroneus longus, peroneus brevis, gastrocnemius, soleus, plantaris, flexor hallicus longus, flexor digitorum longus and tibialis posterior.

Although some of these muscles (gastrocnemius and plantaris) may also be used in prior art boot jacks, such as those of Clements and Jerry, others are not. Moreover the usage of the gastrocnemius and plantaris muscles using the Clements and Jerry devices is not to the same magnitude as in the boot jack of the present application since they are principly used to flex the knee joint as a primary event.

Other muscles which are actively recruited in removal of a boot using the boot jack of the present invention, but not in such prior art boot jacks include flexor hallicus brevis, flexor hallicus longus, flexor digitorum longus, flexor digitorum brevis, quadratus plantae and lumbricales pedis. These muscles plantar flex the metatarsophalangeal joints, of which the principle one of utility in the boot jack of the present application is the first metatarsophalangeal joint.

After the ankle and metatarsophalangeal joints have been thoroughly exhausted through plantar flexion, the knee and hip joint are then actively flexed (FIG. 5*d*) to complete the removal of the foot from the boot. In the devices of the Clements and Jerry references, the muscles responsible for flexion of hip and knee joints are simultaneously recruited first, without any attention given to the ankle and metatarsophalangeal joint.

FIGS. 5*a*, 5*b*, 5*c* and 5*d* clearly illustrate that the utilization of muscles about the ankle and metatarsophalangeal joints is very pronounced by leverage, and provides significant leverage, from the front of the boot pressing against the inclined leverage front portion of the platform 14, to achieve the necessary pivoting of the foot and lifting of the leg to achieve alignment of the foot and leg for removal of the boot. If necessary, a plate or block 20 (phantom, FIG. 2) may be provided, at an appropriate height and at an appropriate position on the front of platform 14, to enhance this leverage effect. With this leverage mechanism in place, a different skeletal movement, affording an enhanced range of plantar flexion, and magnifying the use of a different set of muscles, with different orders of recruitment, significantly improved facilitation of boot removal. As well it provides a substantially increased range of plantar flexion, as well as increased ease of insertion of one's heel into the U-shaped notched.

With respect to the other leg, which provides support, both muscles of flexion and extension are simultaneously and synergistically recruited in order to provided rigidity and support to the leg which is being removed from the boot. Although there is very little difference in muscles recruited and utilized in this regard, the main difference here lies in the location of placement of the user's other leg, affording much better and safer stability, in that this leg is placed adjacent or in front, rather than behind the leg on which the boot being removed is located.

Figure 6:
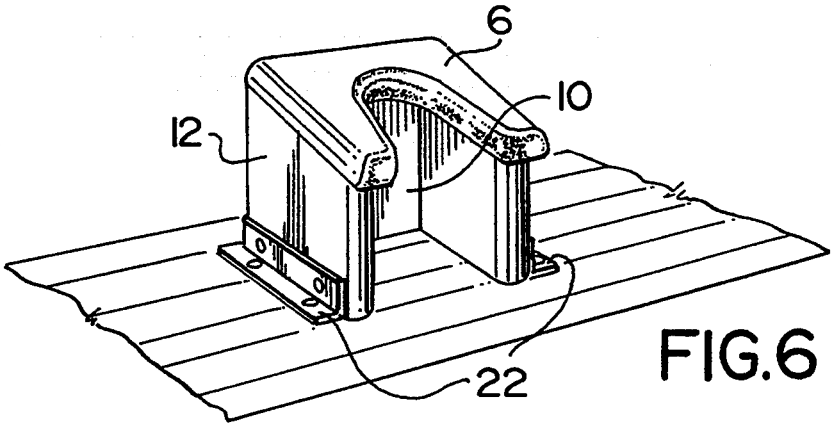
FIG. 6 is an alternative embodiment of boot jack in accordance with the present invention for securing to a base such as a floor.

In the alternative embodiment of FIG. 6, the boot jack comprises plate 6, with back walls 10 and side walls 12, to be secured by means of an appropriate securing means such as L brackets 22, to a base such as for example a floor.

Thus it is apparent that there has been provided in accordance with the invention that fully satisfies the objects, aims and advantages set forth above. While the invention has been described in conjunction with a specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A boot jack for gripping a boot to assist a user in removal of the user's foot therefrom, the jack comprising a frame and a plate secured to the frame, the plate having a U-shaped notch for receiving and gripping the boot above the user's heel, the improvement characterized in that the plate is supported on the frame in a downwardly inclined orientation forwardly, towards the notch the frame being supported on a horizontal base, and the plate being supported at a sufficient height above the base for permitting the user's toes and the front of the boot to press against the base as a fulcrum to facilitate removal of the user's foot by means of plantar flexion from the boot when the boot is gripped in the U-shaped notch.

2. A boot jack according to claim 1 wherein the base is a planar platform to which the frame is secured.

3. A boot jack according to claim 2 wherein the platform extends to either side of the frame and plate, to enable the user to place the user's other foot on the platform beside the boot from which the wearer's foot is to be removed, as well as beneath and in front of the frame and plate, to support the boot being removed and provide a fulcrum point for the front of that boot during removal.

4. A boot jack according to claim 1 wherein the plate has side, back and front edges, the U-shaped notched being in the front edge, and wherein the frame comprises rear and side support walls extending downwardly from the respective rear and side edges of the plate.

5. A boot jack according to claim 3 wherein the plate has side, back and front edges, the U-shaped notched being in the front edge, and wherein the frame comprises rear and side support walls extending downwardly from the respective rear and side edges of the plate.

6. A jack according to claim 1 wherein the plate is tapered in thickness, decreasing towards the notch opening.

7. A jack according to claim 1 wherein the edges of the U-shaped notch are rounded.

8. A jack according to claim 7 wherein the edges of the U-shaped notch towards the rear of the notch are slightly downwardly and outwardly inclined to facilitate receiving and gripping a heel of a boot.

9. A boot jack according to claim 7 wherein the edges of the U-shaped notch are covered with a boot protecting, friction enhancing material.

10. A boot jack according to claim 9 wherein the material is suede.

11. A boot jack for gripping a boot to assist a user in removal of the user's foot therefrom, the jack comprising a frame and a plate, secured to the frame, having a U-shaped notch for receiving and gripping the boot above the user's heel, the improvement characterized in that the plate is supported on the frame in a downwardly inclined orientation forwardly, towards the notch, when the frame is supported on a horizontal base, and an elevation means is provided for positioning on the base forwardly of the plate, beneath a toe portion of a boot for supporting that toe portion and acting as a fulcrum during removal of the boot from the user's foot, the plate being supported at a height above the base to permit the user's toes and the front of the boot to press against the elevation means as a fulcrum to facilitate removal of the user's foot from the boot when the boot is gripped in the U-shaped notch.

12. A boot jack according to claim 11 wherein the elevation means comprises a block having an upper surface inclining in an opposite direction to that of the downwardly inclined plate.

* * * * *